US006411039B1

(12) United States Patent
Vollkommer et al.

(10) Patent No.: US 6,411,039 B1
(45) Date of Patent: Jun. 25, 2002

(54) DISCHARGE LAMP FOR DIELECTRICALLY IMPEDED DISCHARGES WITH IMPROVED ELECTRODE CONFIGURATION

(75) Inventors: Frank Vollkommer, Buchendorf; Lothar Hitzschke, Munich; Simon Jerebic, Regensburg, all of (DE)

(73) Assignee: Patent-Treuhand-Gesellschaft fuer Elektrische Gluehlampen mbH, Munich (DE)

( * ) Notice: Subject to any disclaimer, the term of this patent is extended or adjusted under 35 U.S.C. 154(b) by 0 days.

(21) Appl. No.: 09/787,721

(22) PCT Filed: Sep. 13, 1999

(86) PCT No.: PCT/DE99/02899

§ 371 (c)(1),
(2), (4) Date: Mar. 21, 2001

(87) PCT Pub. No.: WO00/19487

PCT Pub. Date: Apr. 6, 2000

(30) Foreign Application Priority Data

Sep. 29, 1998 (DE) ..... 198 44 721

(51) Int. Cl.[7] ..... H01J 1/02
(52) U.S. Cl. ..... 315/58; 313/491
(58) Field of Search ..... 313/491, 492, 313/493, 607, 633; 315/58, 56, 57

(56) References Cited

U.S. PATENT DOCUMENTS

| | | | | |
|---|---|---|---|---|
| 4,185,229 A | | 1/1980 | Yoshikawa et al. | |
| 4,639,640 A | * | 1/1987 | Hata et al. | 315/3 |
| 5,760,541 A | | 6/1998 | Stavely et al. | |

FOREIGN PATENT DOCUMENTS

| | | |
|---|---|---|
| DE | 43 11 197 | 10/1994 |
| DE | 196 28 770 | 1/1998 |
| DE | 196 36 965 | 3/1998 |
| DE | 198 39 329 | 3/2000 |
| DE | 198 39 336 | 3/2000 |
| DE | 198 44 720 | 4/2000 |
| WO | 94/23442 | 10/1994 |
| WO | 98/43276 | 10/1998 |
| WO | 98/43277 | 10/1998 |

OTHER PUBLICATIONS

Patent Abstracts of Japan, vol. 014, No. 463 (E–0988), Oct. 8, 1990 & JP 02 189854 A (Toshiba Lighting & Technol Corp), Jul. 25, 1990, abstract.

* cited by examiner

*Primary Examiner*—David Vu
(74) *Attorney, Agent, or Firm*—Robert F. Clark

(57) ABSTRACT

This application relates to a discharge lamp for producing dielectric impediments which has a new electrode configuration with a meandering shape. In this case, either the anode(s) or both the anode(s) and the cathode(s) are of meandering shape.

27 Claims, 5 Drawing Sheets

DISCHARGE LAMP FOR DIELECTRICALLY IMPEDED DISCHARGES WITH IMPROVED ELECTRODE CONFIGURATION

TECHNICAL FIELD

This invention relates to a discharge lamp designed for dielectrically impeded discharges. Such a discharge lamp has at least one cathode and at least one anode in a discharge vessel filled with a discharge medium, at least the anode being separated from the discharge medium by a dielectric layer. The mode of operation of dielectrically impeded discharges in such discharge lamps is not of individual interest here. Consequently, reference is made here to the prior art, in particular to the documents still to be cited below.

In particular, this invention relates to the electrode configuration in a discharge lamp for dielectrically impeded discharges.

PRIOR ART

The invention proceeds from strip-shaped electrodes known per se. Strip-shaped electrodes are provided, in particular, for discharge lamps in the form of flat radiators which essentially comprise two plane-parallel plates which are, if appropriate, connected by a frame. In this case, the strip-shaped electrodes are generally formed on one or more of the walls of these plates, it being possible for dielectrically impeded discharges to be produced in a correspondingly flat discharge volume between the plates. Generally, the strip-shaped cathodes and anodes run essentially parallel to one another in this case.

Strip-shaped electrodes are also, of course, possible on other discharge lamps, particularly in conjunction with differing discharge vessel geometries. They can also be deposited in the case of non-flat discharge vessels on inner or outer surfaces of boundary walls forming the discharge vessel, or also independently of a discharge vessel wall, for example on a plate, carrying the electrode strips, inside the discharge vessel. In particular, the invention is therefore directed towards strip-shaped electrodes which are applied to a wall of the discharge vessel or to a wall in the discharge vessel.

However, in principle this invention requires no carrier for the electrode strips.

The invention therefore proceeds from a discharge lamp having a discharge vessel filled with a discharge medium, a strip-shaped cathode and a strip-shaped anode as well as a dielectric layer between the anode and the discharge medium.

Essential criteria in the development and assessment of electrode configurations in the discharge lamps considered here, which have dielectrically impeded discharges are, in addition to an advantageous electrical performance of the electrode configuration as electrical component, the geometrical properties of the electrode configuration and/or the discharge structures to be produced using it. Importance can attach here, on the one hand, to the uniformity of the production of light both in time and in space, that is to say to the temporal freedom from fluctuation and to as homogeneous a surface distribution as possible. Of course, it is also possible for specific inhomogeneous surface distributions to be intended. Furthermore, interest also attaches, moreover, to the surface luminance to be achieved with the discharge lamp for specific applications, for example in the field of flat screen backlighting, or in signal lamps.

SUMMARY OF THE INVENTION

Overall, the present invention is based on the technical problem of specifying a discharge lamp for dielectrically impeded discharges having an improved electrode configuration, and a lighting system containing such a discharge lamp and also a suitable ballast.

According to the invention, this problem is solved by means of a discharge lamp of the type denoted above, which is characterized in that the anode runs in a meandering shape such that the spacing between the cathode and the anode is modulated by the meandering shape, or is characterized in that the cathode and the anode run in a meandering shape, the meandering shapes running in phase opposition locally relative to one another such that the spacing between the cathode and the anode is modulated by both meandering shapes.

Furthermore, the invention relates to a lighting system having one of these two discharge lamps and a ballast which is designed for pulsed coupling of active power into the discharge lamp.

Numerous preferred refinements of the discharge lamp and the ballast, and thus of the lighting system, are specified in the dependent claims and described in more detail below.

In its most general form, the invention is to be considered in two variants as regards the discharge lamp. The first variant presupposes the inventive meandering course of the electrodes only for the anode. The precise course of the strip-shaped cathode is basically open in this case, although the meandering shape of the anode is intended to modulate the spacing, decisive for the discharge, between the cathode and the anode. For this purpose, the cathode can have a straight form of strip, or else any other desired form of strip, as long as the modulation of the discharge spacing by the meandering shape is not nullified thereby or overlaid by a form which influences the discharge spacing in another way so strongly that the effect intended by the invention is lacking. In particular, however, it is also possible in this case for the cathode to have a meandering shape, this corresponding to a special case of the second variant of the invention.

In this case, it is a precondition for this first variant, discussed here, of the invention that the anode of the discharge lamp is distinguished from the cathode in some form, that is to say can be distinguished from the cathode in principle. This can be the case, in principle, in many different forms, in the simplest case by virtue of the fact that there is no dielectric layer between the cathode and the discharge medium.

However, use is also made occasionally of a dielectric layer on the cathode or cathodes, in order to protect them against sputtering damage by the ion bombardment from the discharge medium. In this case, the dielectric layer on the cathode or cathodes is frequently thinner than the dielectric layer as regards the anode. The anode is distinguished from the cathode in this case too.

This even includes the case in which the anode is distinguished only by an appropriate designation on the discharge lamp, for example by a polarity symbol on its electric connection. Basically, it may be stated in this context that both a bipolar and a unipolar power supply are possible in the case of discharge lamps for dielectrically impeded discharges. In the bipolar case, the cathodes and anodes naturally alternately exchange their electrical roles, and therefore cannot be distinguished from one another in operation. The statements made in this description for one of the two types of electrode then hold for both types of electrode. Conversely, this means for the first variant, just discussed, of the invention that such a discharge lamp is designed for a unipolar operation.

The second variant of the discharge lamp according to the invention will firstly be represented before then discussing in detail the effects and advantages of the meandering shape according to the invention. In this case, the meandering shape relates to both types of electrode, that is to say at least one cathode and at least one anode run in a meandering shape. It is provided in this case that the meandering shapes reinforce one another with regard to the modulation of the discharge spacing between the cathode and the anode. They run in phase opposition relative to one another for this purpose.

However, the invention is to be understood in this case to be generalized to the extent that the meandering shapes of the electrodes need not be periodic. Consequently, the term phase opposition possibly relates only to a periodicity which is local and altered at a different point, and possibly to nonperiodic cases as well in which, however, in essence "peak strikes trough" and "trough strikes peak" locally, the electrodes thus being guided towards or away from one another essentially at the same points.

It is also to be clarified that the described reinforcement of the meandering shapes in phase opposition need not necessarily mean algebraic addition of the "stroke", respectively associated with the meandering shape, in the direction of the discharge spacing. Rather, the meandering shapes can also lie in different planes which need not necessarily run parallel to one another either. For example, the electrode strips can be formed on opposite inner walls of a discharge vessel.

It holds for both variants of the invention that the discharge spacing between cathode and anode is modulated by at least one meandering shape of an electrode. Consequently, the respective points of the locally smallest discharge spacing simultaneously form points of the locally strongest field, and thus preferred root points for individual discharge structures.

Specifically, the discharge lamps according to the invention are particularly advantageous in conjunction with a method for pulsed coupling of active power, which is not described here in more detail. WO 94/23 442 and/or German Patent 43 11 197.1 may be cited for this purpose, and their disclosure is hereby incorporated by reference. In the operating method described there for dielectrically impeded discharge lamps, it is preferably spatially largely stable individual discharge structures which are produced, and they are formed in accordance with the coupled active power in different numbers, initially at the points with the respectively highest field strengths between electrodes. It is also possible for less localized "curtain-like" discharge structures to form, but they are equivalent within the scope of this invention.

Of course, in the case of the divergent operating method conceivable in principle, discharges also come about between the electrodes exclusively, or at least preferably at the points between the electrodes at which the highest field strengths occur. Consequently, the statements relating to this invention also hold in a more general sense.

Electrode structures for local field reinforcement which are provided for the purpose of improving the temporal and spatial inhomogeneity of the overall picture from individual discharges have already been described in DE 196 36 965 A1. Here, in particular, nose-like punctiform projections are provided on electrode plates or electrode wires which otherwise run in a straight line. This document is likewise expressly cited, its disclosure thereby being incorporated by reference here.

By contrast with this prior art, in the case denoted above as the first variant the present invention is directed towards a local field reinforcement through shaping the anode. However, the cited prior art provides projections on the cathode for the unipolar case. Specifically, the prior art was then based on the idea that the discharge structures at the cathode which occur in the case of the pulsed operating method exhibit more of a pointed form on the cathode and a fanned-out form on the anode. Consequently, the corresponding tip of the discharge structure should be localized by geometrically shaping the cathode, for which reason essentially punctiform noses on the cathode have logically preferably been taken into consideration.

However, it has been observed in the case of this invention that the more fanned-out sides of the discharge structures can likewise be localized relative to the anode, specifically by anode shapes which are defined here as meandering. This term covers many different conceivable shapes which run with undulations in some way or other, but need not necessarily be round. Striking examples are sinusoidal waves, rectangular waves, sawtooth waves etc.

Whether in combination with a meandering cathode in accordance with the so-called second variant or not, a meandering anode offers substantial advantages, however, by comparison with the conventional structures. Thus, by comparison with the nose-type projections, already described, according to the prior art, a meandering shape is substantially more favourable in capacitive terms, because spacings which are conspicuously larger than the spacing which is actually decisive for the discharges can occur between the electrode strips on a substantial fraction of the electrode length, at the points where the electrodes come closest together. However, with a reduced capacitance of the electrode configuration, and thus smaller reactive currents, the ballasts required for fit operating the discharge lamps can be of smaller design, so that economies can be made in costs, overall volume and weight. Furthermore, steeper pulse edges, and thus better pulse shapes overall, can be implemented in conjunction with smaller operating capacitances.

In a preferred embodiment, the discharge lamp provides an electrode configuration made from a plurality of cathodes and a plurality of anodes which are arranged alternately in individual strips. This means that in each case only one anode strip runs between two cathode strips, and vice versa. Of course, the capacitive points of view hold in the case of this embodiment, as well, and even to a greater extent with regard to the electrodes surrounded by electrodes of opposite polarity. Moreover, this embodiment holds here with its advantages for the two variants of the invention distinguished at the beginning.

However, yet a further aspect of the invention comes to light in the case of the alternating arrangement. Specifically, the term "meandering shape" already discussed necessarily means that in the case of a meandering electrode which is adjoined on two sides by respective electrodes of opposite polarity, the preferred points for the respective discharge structures alternate relative to the two sides along the electrode considered. It has now emerged in the scope of the invention that this is particularly important for an anode, since the abovementioned somewhat fanned-out sides of a plurality of individual discharge structures "interfere" with one another at one and the same anode. This means that it is not possible to build up a stable overall discharge pattern given an excessively small spacing between the anode-side ends of the discharge structures.

This holds for all electrodes, of course, in the case of a bipolar power supply. In the unipolar case, the discharge structures on the cathodes hardly interfere with one another at all. Here, however, a meandering shape in conjunction with the described alternating electrode arrangement is of considerable advantage for capacitive reasons, as set forth elsewhere. Moreover, the meandering shape leads to a larger spacing between the cathode-side "pointed" ends of the discharge structures on the cathode strip. This is advantageous because the discharge tips on the cathodes have, as it were, a feed zone on both sides of the cathode strip in which a surface glow discharge can burn visibly on the cathode strip; it is evidently associated with the supplying of electrons for the discharge structure. If the spacing between the discharge tips is now larger, there is also therefore an increase in the size of this feed zone on the cathode, and this benefits the effectiveness of the lamp overall.

However, in accordance with the first variant the invention also includes the case of the strip-shaped cathode having no such meandering shape. It can run in a straight line in a conventional way, in particular within the scope of this first variant. Particularly in cases in which the mutual interference of the individual discharge structures with their narrow cathode-side end as compared with the widely fanned-out anode side plays a conspicuously subordinate role, for example in the case of particularly large discharge spacings, straight cathode strips have the advantage that they permit as dense an arrangement as possible of the individual strips from discharge structures in the direction transverse to the strip direction. In this case, a meandering anode shape according to the invention can once again be used to take account of the mutual interference of the individual discharge structures.

It is preferred in this case that the meandering shapes of two anodes adjacent to the same cathode run in phase locally relative to one another, in order to achieve an alternating arrangement of the preferred discharge points on both sides of the cathode.

Two criteria which are mutually independent in principle have proved to be sensible with regard to a quantitative geometrical description of preferred regions for the electrode configurations according to the invention. The first criterion relates to the ratio between the fluctuation in the discharge spacing, that is to say the difference between the maximum discharge spacing $d_{max}$ within half a period length and the minimum discharge spacing $d_{min}$ in the same half period, and this half period length of the meandering shape, which is denoted below by the acronym SL, itself. A value of 0.6 has proved to be favourable as upper limit for this ratio. The value 0.5 is better, and 0.4 is particularly preferred.

The ratio just described can also assume very small values within the scope of the invention, as long as it differs from zero. Perceptible effects of the invention can already be achieved starting from values of, for example, 0.01.

The second criterion relates to the minimum discharge spacing, already incorporated by reference, as it relates to the maximum discharge spacing occurring with regard to the discharge structures actually occurring during operation of the discharge lamp in accordance with design. It must be recalled for this purpose that, both in the case of relatively localized discharge structures and in the case already mentioned involving widening "in the fashion of a curtain", an individual discharge structure has a certain "averaging" expansion, and thus spans a certain variation in discharge spacings. Here, an individual discharge structure will in many cases not even reach the maximum discharge spacing, but will do so only given a relatively strong power coupling. The terms minimum and maximum discharge spacing thereby relate rather to the discharge spacings which can be achieved in principle during operation of the lamp than to the discharge spacings actually implemented in a specific operating state. The minimum discharge spacing is preferably greater than 30% and smaller than 90% of the maximum discharge spacing, but preferably larger than 40% or 50% of the maximum discharge spacing.

As mentioned, in this case the maximum striking distance does not necessarily correspond to the maximum striking distance actually achieved by discharge structures in a specific operating state, but to the striking distance which can be achieved in the electrode configuration of the specific discharge lamp. A further possibility according to the invention is important in this connection, specifically operating the discharge lamp with a ballast which is suitable for power control in the discharge lamp. Here, in a power control device of the ballast a suitable electric parameter of the power supply of the discharge lamp is changed such that an arc voltage of the discharges is varied and the individual discharges can bridge more or less large striking distances in the electrode configuration. Consequently, there is a change either in the overall volume of individual discharge structures, or in the number of individual discharge structures at the respective preferred points between the electrodes. Thus, it is possible, in particular, for a plurality of individual discharge structures to occur next to one another at the same preferred point of the electrode configuration. For further details in this regard, reference may be made to the parallel application "Dimmbare Entladungslampe fur dielektrisch behinderte Entladungen" ["Dimmable discharge lamp for dielectrically impeded discharges"] from the same applicant with the file reference DE198 44 720.5. The disclosure of this application is hereby incorporated by reference.

The delimitation undertaken in the above discussions relative to the document DE 196 36 965 A1 incorporated by reference is not to be understood so as to exclude the possibilities described there for forming points of local field reinforcement in the electrode configuration in the case of this invention. Rather, they can be implemented in addition to the features according to the invention and also be entirely advantageous in this case. An example is the facilitation of the striking of an individual discharge when beginning to operate the discharge lamp, specifically particularly in the case of those electrode configurations which do not already have a corner or tip in the meanders which fulfils the same function. Reference may be made to the exemplary embodiments in this regard.

A further aspect of the invention relates to particular embodiments for the electrode surface in the regions between the meanders. What is meant here by the regions between meanders, for example in the case of the above-mentioned sinusoidal shape, is the straight pieces or the middle part of the straight pieces between the individual arcs, that is to say, from the mathematical point of view, zero crossings or points of inflection. These regions correspond to a certain extent to the boundaries between the discharge structures on two sides of the same meandering shape, and can be designed according to the invention such that they render a widening of a discharge structure into these regions difficult or impossible.

The first possibility in this regard consists in specifically varying the grain size of a layer applied to the electrode, fluorescent layers being particularly suitable. In this case, a more coarsely grained fluorescent material should be selected in the region between meanders than in the meander bows. The meander bows can also be entirely free from fluorescent material.

Another possibility with the same aim consists in varying the layer thickness of a dielectric layer located on the electrode. The dielectric layer should then be thicker in the region between the meanders than in the remaining region. In the case of the cathodes, it is also possible here to form the remaining regions entirely without a dielectric layer.

As already set forth, the invention also relates to a ballast. According to the invention, in this case the ballast is suitable for the above-described pulsed method of coupling active power, or is designed therefor. The power control function possible in this connection or, in the continuous or approximately continuous case, the dimming function has already been considered.

From the point of view of the ballast, it has proved to be worthwhile to pursue the avenue of selecting a unipolar coupling of active power. This means that the external voltage applied to the discharge lamp in the case of the active power pulses always has the same sign, apart from small exceptions caused by technically parasitic effects. This does not necessarily mean that the current flowing through the discharge lamp is unipolar. Rather, intentional restrikings can occur in the discharge lamp which have an appropriately inverted current sign but which in the unipolar case are not a direct consequence of an external lamp voltage.

Two further parallel applications from the same applicant on the same date of application in this case relate to operating methods and ballasts, also in particular for the discharge lamp in accordance with the present invention, which preferably come into consideration here. Reference is made to the German parallel applications with file references 198 39 336.9 and 198 39 329.6 dated Aug., 28, 1998. These each describe a ballast using a forward converter principle with the aid of an operating method designed to produce restriking without a bipolar external lamp voltage and a ballast using a combined flyback/forward converter principle with a similar aim. The disclosure of these applications is also hereby incorporated by reference.

On the other hand, the bipolar mode of operation is particularly suitable for those electrode configurations in which both of electrode ([temporary] anode and [temporary] cathode) have a meandering shape. The first reason for this is the geometrical symmetry of the electrode configuration. However, suitability for bipolar operation further requires all the electrodes to be covered with a dielectric layer (two-sided dielectric impediment). Consequently, from the point of view of physical discharging, as well, the electrodes are of the same type and assume the role both of a temporary anode and a cathode alternately over time.

An advantage of the bipolar mode of operation can reside, for example, in rendering the discharge conditions in the lamp symmetrical. Problems caused by asymmetrical discharge conditions can thereby be avoided particularly effectively, for example ion migrations in the dielectric, which can lead to blackening, or space charge accumulations which worsen the efficiency of the discharge.

A modified forward converter, for example, comes into consideration as ballast for the bipolar operating method. The modifications are aimed at ensuring a reversal of direction in the primary-circuit-side current, effecting the voltage pulse in the secondary circuit, in the transformer of the forward converter. This is generally simpler than corresponding electrical measures for reversing direction on the side of the secondary circuit.

In particular, for this purpose the transformer can have two windings on the primary-circuit side which are each assigned to one of the two current directions, that is to say only one of the two directions is used for a primary circuit current. This means that current is applied alternately to the two windings on the primary-circuit side. This can be performed, for example, by using two clocking switches in the primary circuit which respectively clock the current through an assigned one of the two windings. Each of the two current directions is thus assigned to a dedicated clocking switch and a dedicated winding of the transformer on the primary-circuit side.

When a ballast according to the invention is used on an AC source, it can be advantageous with reference to the two current directions on the primary-circuit side to make use of two storage capacitors which are alternately charged in half periods from the AC source. Thus, the AC half periods of one sign are used for one of the storage capacitors, and the AC half periods of the other sign are used for the other storage capacitor. The currents for one direction each can then be withdrawn from these two storage capacitors. This operation can be performed together with the outlined double design of the primary winding of the transformer, but such a design is not actually necessary here. Rather, a single winding on the primary-circuit side can be supplied from the two storage capacitors alternately by appropriate switches, each storage capacitor respectively being assigned to a current direction. An appropriate rectifier circuit, the details of which are immediately clear to the person skilled in the art, can be used to feed the storage capacitors from the AC source.

DESCRIPTION OF THE DRAWINGS

A few exemplary embodiments for electrode configurations according to the invention are explained below with the aid of the attached figures, it being possible for the individual features illustrated also to be essential to the invention in other combinations. In detail.

Figure 1:
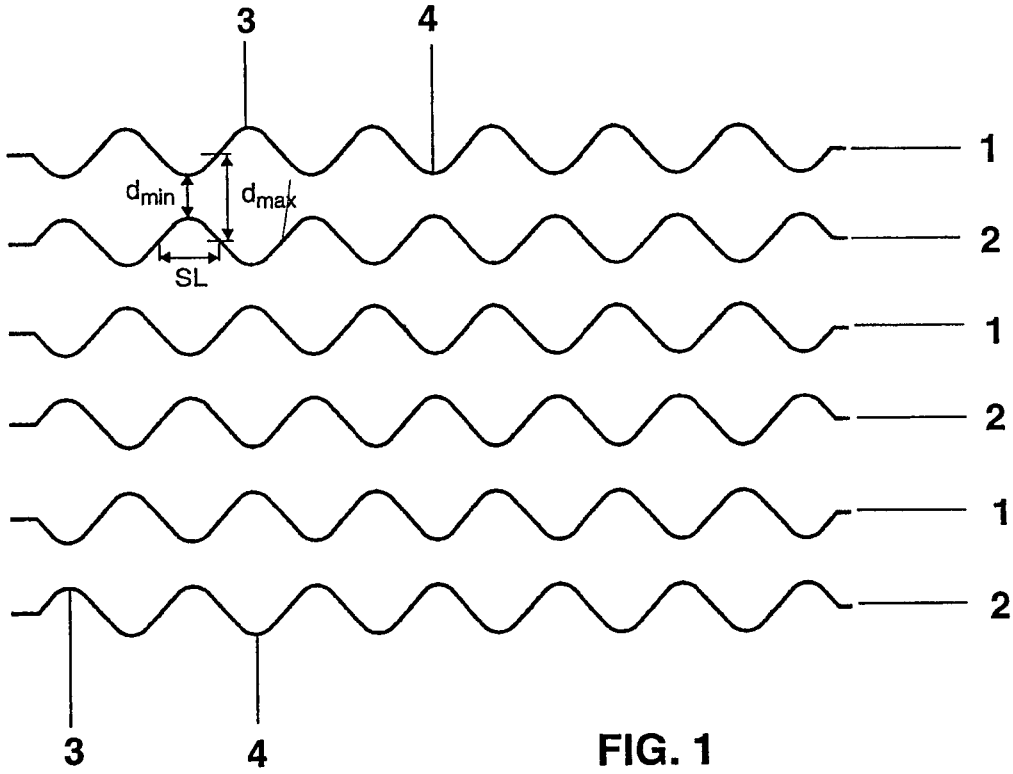
FIG. 1 shows a schematic illustration of an electrode configuration with sinusoidal anodes and cathodes.

Represented in FIG. 1 is a schematic illustration of an electrode configuration of anodes 1 and cathodes 2 which alternate in individual strips and run essentially parallel to one another. Disregarding a right-hand and a left-hand straight connecting piece, in this case all anodes 1 and cathodes 2 have a sinusoidal meandering shape, immediately adjacent anodes 1 running in phase with one another and immediately adjacent cathodes 2 running in phase with one another, and immediately adjacent anodes and cathodes running, in turn, in phase opposition with one another.

If upwardly pointing bows 3 of the sinusoidal shape are denoted in FIG. 1 as maxima, and downwardly pointing bows 4 are denoted as minima, cathode maxima 3 therefore meet anode minima 4 and vice versa, that is to say they are respectively opposite one another in an immediately adjacent fashion. Consequently, the points of highest field strength are respectively situated between a maximum 3 and a minimum 4.

Individual discharge structures, which are not illustrated here, initially form at these points. Given adequate power coupling, all preferred points are occupied by a respective individual discharge structure. According to the invention, a further rise in the power feed, for example through an increase in the amplitude of the external voltage applied to the discharge lamp, now leads to a widening of the respective individual discharge structures from the region of the immediate maxima 3 and minima 4. In this case, a corresponding power control device of a ballast can be used to raise the power until the individual discharge structures are reached at the boundary regions between the maxima 3 and the minima 4, that is to say in the surroundings of the points of inflection. This results in a dimming region which can be traversed entirely continuously by means of a curtain-like widening of the individual discharge structures. Reference is made for this purpose to the parallel application already incorporated by reference.

Also illustrated in FIG. 1 are the already described geometrical variables of half period length SL, minimum discharge spacing $d_{min}$ and maximum discharge spacing $d_{max}$. The half period length SL corresponds in this case to the control region of the dimming function mentioned, by virtue of the fact that the width of the discharge structure can be set. The minimum discharge spacing corresponds to the spacing between an immediately adjacent maximum 3 and minimum 4. The maximum discharge spacing does not, however, correspond to the spacing between a maximum 3 and a minimum 4, which respectively point to opposite sides. Rather, the maximum discharge spacing $d_{max}$ corresponds to the discharge spacing at the outer boundaries of the control length SL. The adjoining half periods of the sinusoidal wave do not belong to the control length SL, and therefore also do not define a larger discharge spacing dug, because they serve the purpose of discharges to the electrodes respectively adjacent on the opposite side (for example not used for discharges in the case of edge electrodes).

Figure 2:
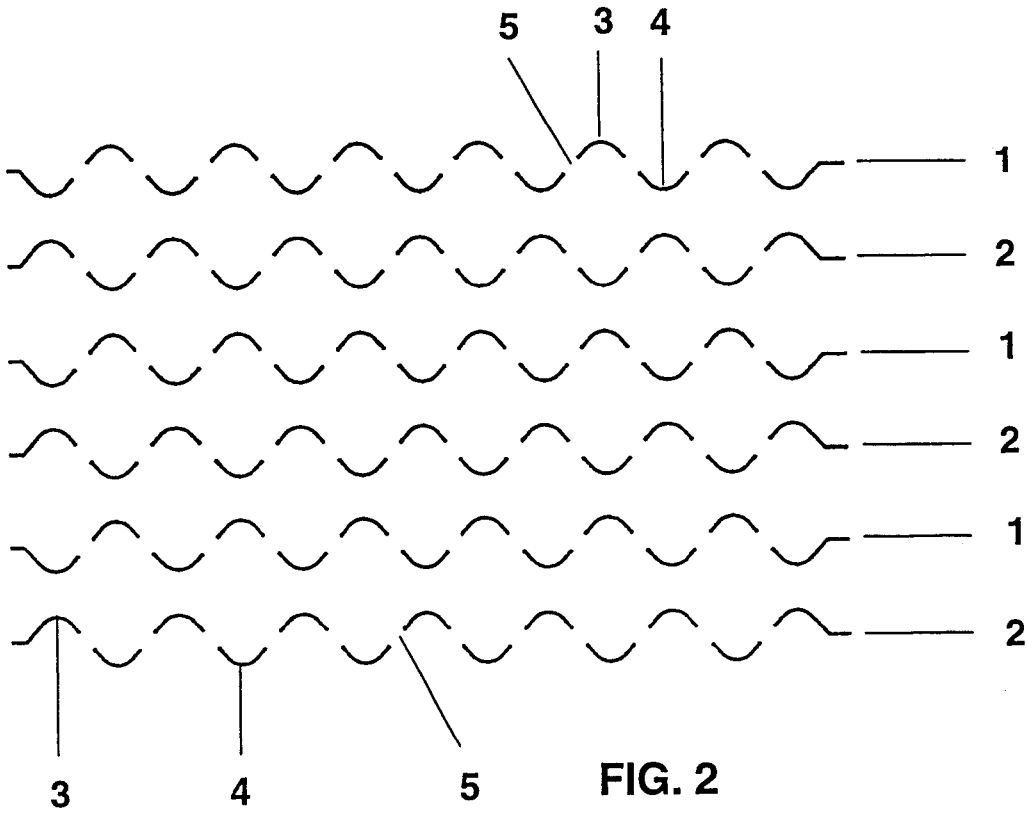
FIG. 2 shows a variant of the electrode configuration in FIG. 1.

A largely identical structure is shown in FIG. 2, but in this case a cutout in the line drawn between the maxima 3 and the minima 4 in the region 5 of the points of inflection is intended to indicate a thickening of the dielectric layer present there.

Specifically, in the case of all the exemplary embodiments illustrated here the anodes 1 and the cathodes 2 are symmetrical, that is to say cannot be distinguished from one another. Consequently, both types of electrode are covered with a dielectric layer. The regions 5 in FIG. 2 correspond to an increased layer thickness of the dielectric.

The already-described variants, associated with the grain size of the fluorescent material, of a particular structuring of these regions 5 between meanders are also possible here.

With regard to the first variant, thus designated, of the invention, there is virtually no divergent representation in the figures; all that would be required in FIG. 1 is to imagine a dielectric coating of the anodes 1 and cathodes 2 which alternates in layer thickness, or an alternating coating and non-coating.

Figure 3:
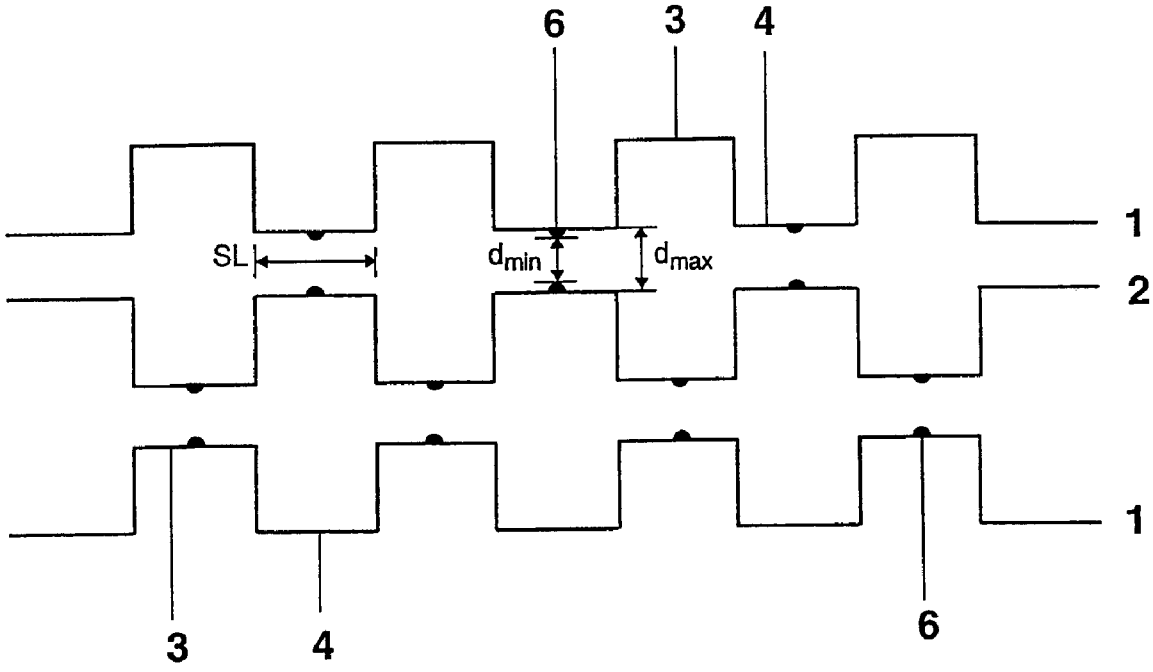
FIG. 3 shows a schematic illustration of a further electrode configuration with anodes and cathodes in the shape of rectangular waves.

An alternative meandering shape is shown in FIG. 3, specifically a shape of the type of a rectangular wave for the anodes 1 and cathodes 2. Consequently, the maxima 3 and the minima 4 are not localized in this example, but correspond to a half period of the respective electrode strip.

In this example, therefore, nose-like projections 6 are provided on the maxima 3 and minima 4, and face the respectively adjacent minima 4 or maxima 3.

These nose-like projections 6 facilitate the initial striking of discharge structures, and fix the discharge structures centrally in the regions, expanded in this example, of the maximum field between the electrode strips as long as the power supply does not lead to a widening of the discharge structures over the entire width of the half period.

The abovementioned geometrical variables are also illustrated in FIG. 3. The half period length SL corresponds to the linear extent of the maxima 3 or minima 4. The minimum discharge spacing $d_{min}$ corresponds to the spacing between the described nose-like projections 6, whereas the maximum discharge spacing corresponds to the discharge spacing in the adjacent straight region of the electrodes. It is clear in this figure that the minimum discharge spacing $d_{min}$ is only slightly smaller than the maximum $d_{max}$.

Figure 4:
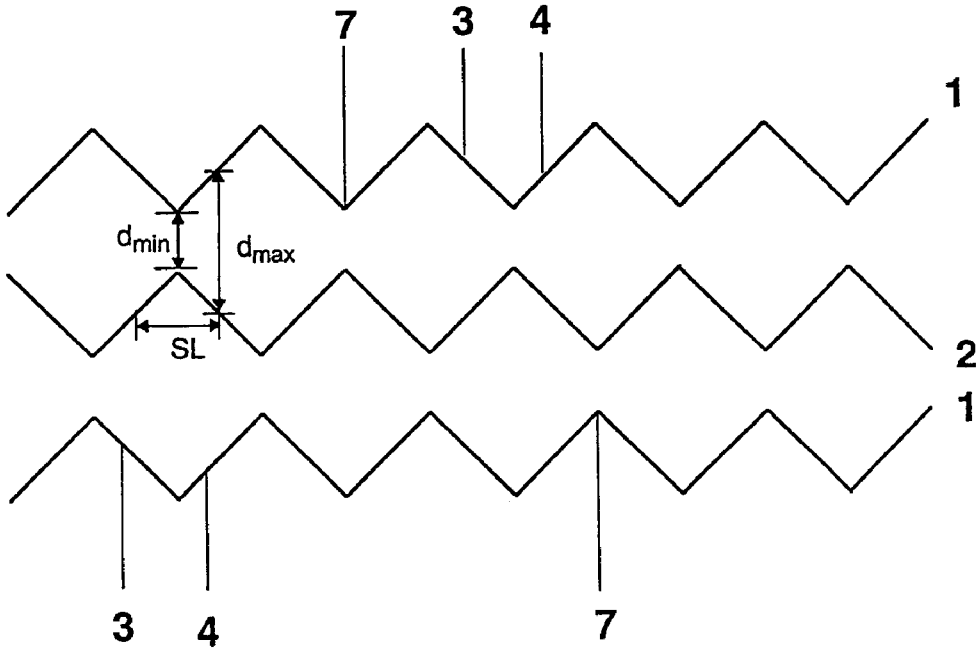
FIG. 4 shows a further schematic illustration of an electrode configuration with anodes and cathodes in the shape of saw teeth.

A facilitated striking can, however, also be performed by the meandering shape as such, as shown by the example in FIG. 4 with a sawtooth shape.

Here, the reference numerals 3 and 4 denote the respective meanders of the saw tooth, that is to say the regions around a maximum and minimum. The maxima and minima themselves correspond respectively to a punctiform corner 7, which therefore has the function of facilitating striking in the same way as the nose-like projections 6 already discussed with the aid of FIG. 3.

Once again, the geometrical reference variables SL, $d_{min}$ and $d_{max}$, which have been repeatedly mentioned, are illustrated in FIG. 4, the explanation here being similar to FIG. 1.

Of course, it is also possible in the case of this exemplary embodiment to provide measures, as with the example in FIG. 2, in the case of the regions between meanders which correspond here to the middle region of each straight section of the sawtooth shape. However, this is not illustrated separately.

Figure 5:
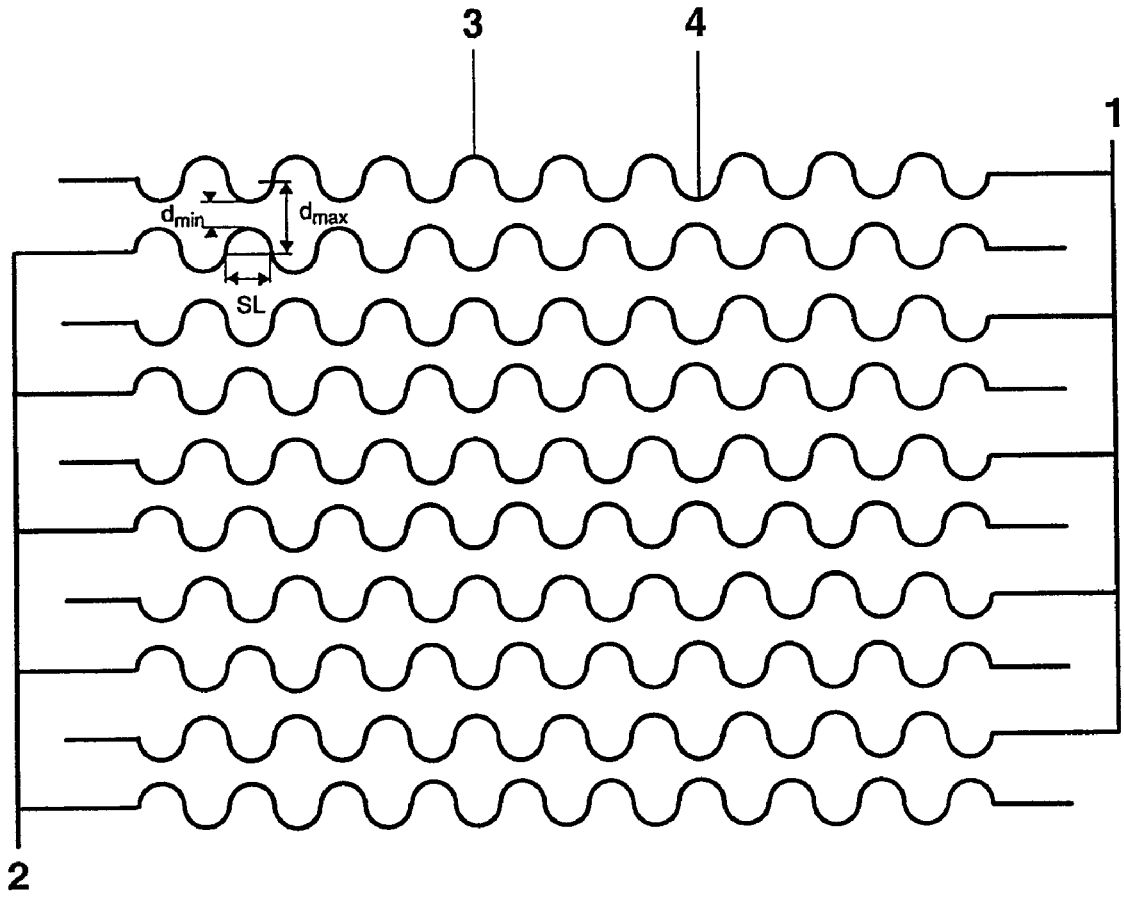
FIG. 5 shows a further schematic illustration of an electrode configuration with anodes and cathodes in the shape of semicircular waves.

FIG. 5 shows electrode tracks in the shape of semicircular waves, that is to say the shape of each electrode corresponds to a sequence of semicircles which are joined to one another alternately in mirror fashion relative to the longitudinal axis of the respective electrode track, this being done in such a way that the upwardly pointing semicircular arcs 3 can be denoted as maxima, and the downwardly pointing semicircular arcs 4 as minima. In other words, the electrode tracks in FIG. 5 can be conceived as having been produced from those in FIG. 1 by virtue of the fact that each sinusoidal half wave has been replaced by an appropriate in-phase semicircle.

The following dimensions (in mm) hold for the geometrical variables of minimum discharge spacing $d_{min}$, maximum discharge spacing $d_{max}$ and half period length SL for the exemplary embodiments in FIGS. 1, 2, 3, 4 and 5:

| Example | $d_{min}$ | $d_{max}$ | SL |
|---|---|---|---|
| FIG. 1 | 5 | 8 | 9 |
| FIG. 2 | 5 | 6 | 6 |
| FIG. 3 | 5 | 6 | 8 |

-continued

| Example | $d_{min}$ | $d_{max}$ | SL |
|---|---|---|---|
| FIG. 4 | 6 | 10 | 17 |
| FIG. 5 | 4 | 8 | 5 |

In the overall comparison of the electrode configurations illustrated in FIGS. 1–5, FIG. 4 is distinguished by a particularly favourable striking performance.

The example in FIG. 3 is less favourable for various reasons, firstly because of the relatively large capacitance owing to the electrode strips, which run close to one another over a relatively wide region. Secondly, disregarding the respective nose 6, in the region of the extended maxima 3 and minima 4 there is here no further pronounced dependence of the discharge preconditions on location, for which reason this structure is initially poorly suited to power control. However, it would be possible here to use other measures than varying the discharge spacing —as in examples in FIGS. 1, 2 and 4—to create such an inhomogeneity, for example varying the electrode width. Only then can the half period width SL be denoted as control length. Reference may be made once again, for this purpose, to the already cited parallel application regarding power control.

By contrast with the sinusoidal shape in FIGS. 1 and 2, the sawtooth shape in FIG. 4 has, in turn, the disadvantage that, because of the corners 7 of the sawtooth shape, there is also a certain concentration of current on the anode side of a discharge structure—in the bipolar case, the instantaneous anode side. However, for the purpose of optimizing the overall efficiency of the discharges and the discharge lamp, efforts must be made to extend the individual discharges in themselves as far as possible spatially, and to create regions of increased charge carrier concentration which are as few or small as possible.

The double sinusoidal shape illustrated in FIGS. 1 and 2 therefore offers a favourable compromise as regards the efficiency of the discharges, the overall capacitance, the power control properties, the achievable surface luminance and the uniformity of this luminance.

The semicircular waveform shape illustrated in FIG. 5 is distinguished from the sinusoidal shape illustrated in FIGS. 1 and 2 by shallower gradients in the region of the control length SL, which has a positive effect on the controllability of power, that is to say the dimming performance. For this reason an exemplary embodiment based on the electrode configuration illustrated in FIG. 5 may be explained in more detail below. This is a flat lamp with a discharge vessel (not illustrated) which is formed from a baseplate and a front plate as well as a circumferential frame. The plates consist of glass of thickness 2 mm and dimensions of 105 mm by 137 mm. The height and width of the frame are both 5 mm. The inner area of the baseplate is 78 mm by 110 mm. The electrode configuration in FIG. 5 is arranged on the baseplate and covered with a glass solder (not illustrated) with a thickness of approximately 150 $\mu$m (discharge dielectrically impeded on both sides). Consequently, this flat lamp is also suitable for the bipolar variant of the operating method. Moreover, a light-reflecting layer made from $Al_2O_3$ or $TiO_2$ is applied to the baseplate and the frame. A three-band fluorescent layer follows thereafter on all inner surfaces. The discharge vessel is filled with xenon at a pressure of approximately 13 kPa. In the case of a unipolar mode of operation and a voltage pulse frequency of 80 kHz, it is possible using the peak voltage as controlled variable to influence the widths of the delta-shaped partial discharges (not illustrated) in the region of the respective control length SL. The average power consumption can be increased from 7 W to 10 W in this way, given an increase in the peak voltage from 1.39 kV to 1.49 kV.

Further details on the shape and structure of the characteristic partial discharges produced by the pulsed operation of dielectrically impeded discharges under various operating conditions are to be found in WO 94/23442, already cited.

The electrode configurations illustrated here are all provided for flat radiators such as are described in the earlier application WO 98/43277, for example. The disclosure of this application is also hereby incorporated by reference. As regards further technical details, reference may also be made to the parallel application, already repeatedly mentioned, entitled "Dimmbare Entladungslampe fur dielektrisch behinderte Entladungen" ["Dimmable discharge lamp for dielectrically impeded discharges"] with the file reference DE 198 44 720.5.

Figure 6:
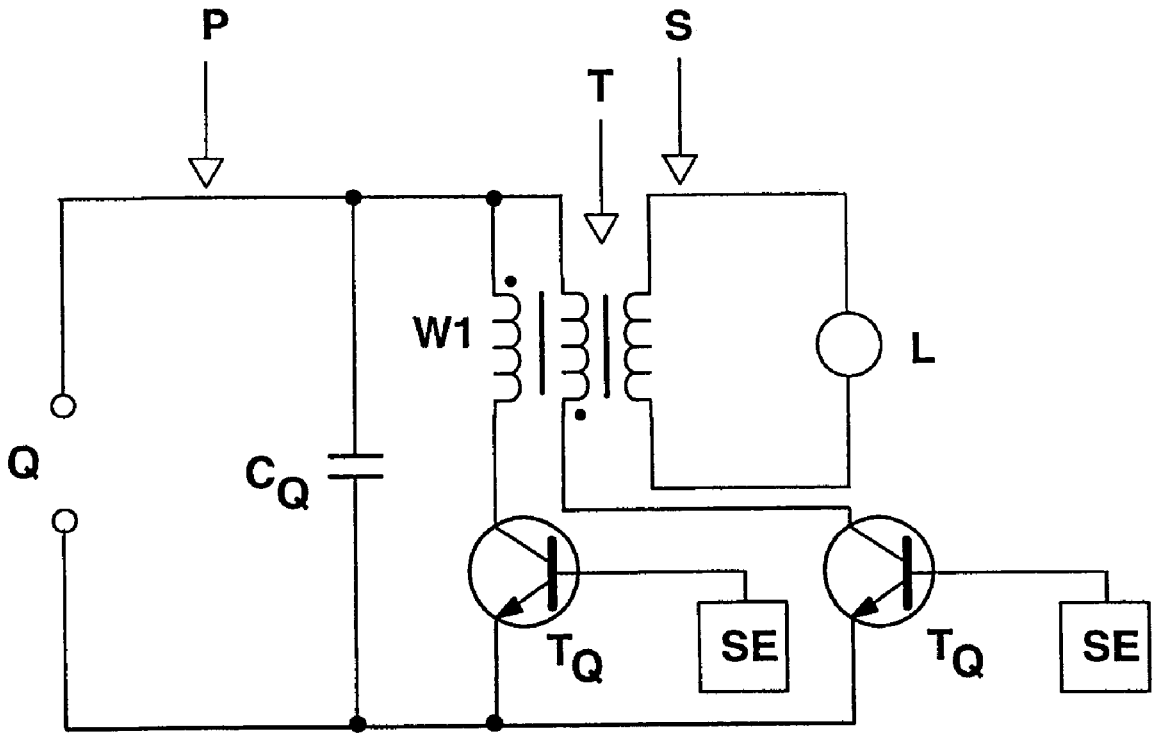
FIG. 6 shows a schematic circuit diagram of a ballast which is suitable for the bipolar variant of the operating method, with a discharge lamp.

FIG. 6 shows a schematic circuit diagram of a ballast which is designed for the bipolar variant of the operating method. Thus, external voltage pulses of alternating polarity are applied to the dielectrically impeded discharge lamp L, for example of the type described in relation to FIG. 5. For this purpose, the transformer T has two primary windings which are illustrated in FIG. 6 with an opposite winding sense. Each of the primary windings is connected electrically in series to an assigned switching transistor $T_Q$ with a dedicated control device SE. Of course, the two control devices can also be understood as two functions of a unitary control device; the aim is merely to symbolize that the two primary windings are not clocked jointly, but alternately. Because of the reversal in winding sense between the two primary windings, upon clocking of the primary windings the transformer T respectively produces voltage pulses of opposite polarity in the secondary circuit S. To summarize, in the case of the circuit in FIG. 1 the module comprising the primary winding W1, the switch $T_Q$ and the control device SE is of double design, a reversal of sign being effected by the winding sense.

Figure 7:
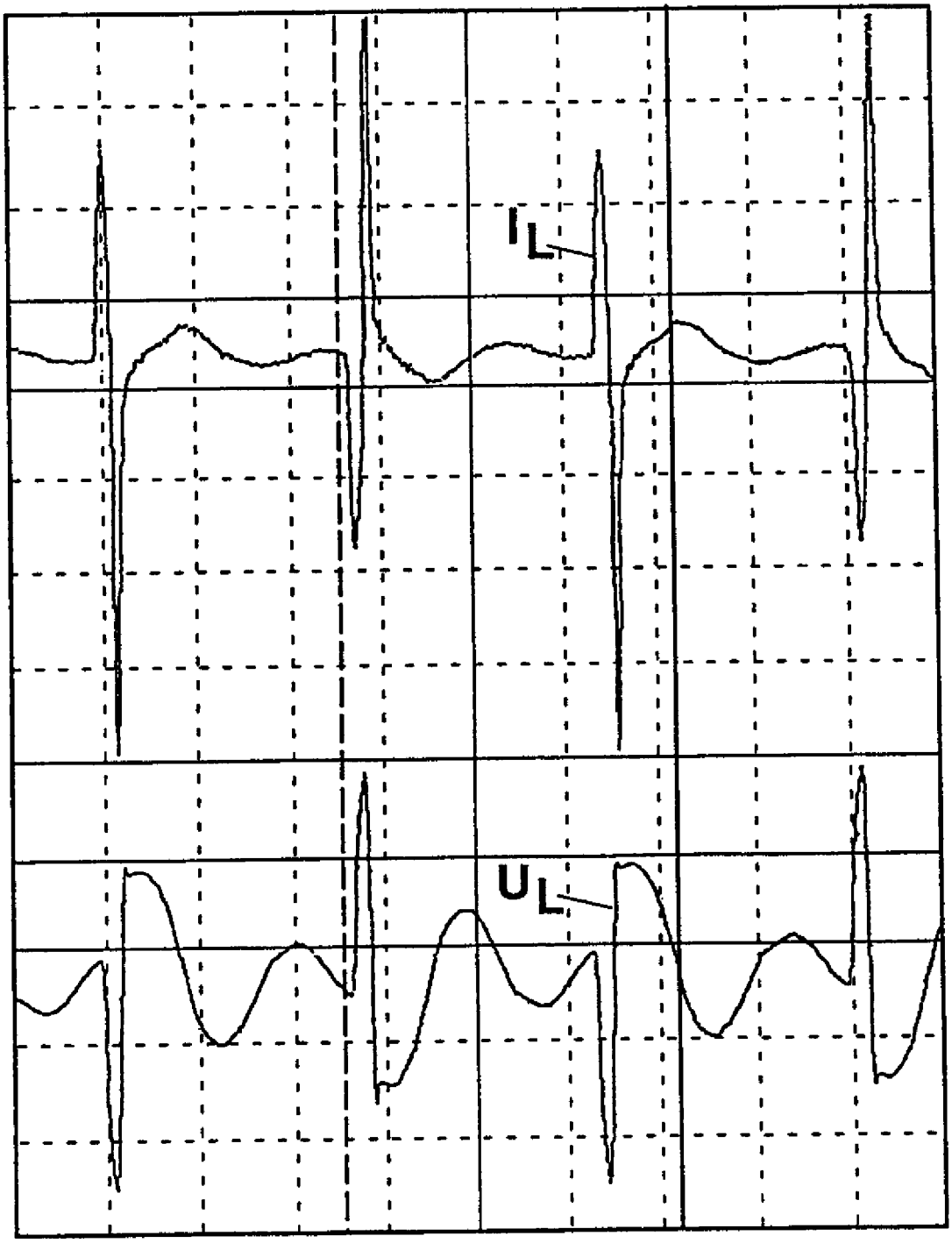
FIG. 7 shows a diagram with measurement curves for the external voltage across and the current through the discharge lamp in the case of the lighting system according to FIG. 6.

FIG. 7 shows corresponding real measurement curves of the external lamp voltage $U_L$ and the lamp current $I_L$. It is to be borne in mind here that the measured external lamp voltage $U_L$ is composed of the voltage of the actual pulse and the voltage of the natural oscillation of the secondary circuit. However, at least the latter has no decisive influence on the discharge. What is decisive, rather, are the actual voltage pulses which effect the corresponding lamp current pulses of the striking and the restriking and finally result in the operation using active power pulses already disclosed in WO 94/23442. The fact that there is a bipolar operating method can be detected both from the striking pulses of the external lamp voltage and from the lamp current pulses of the striking and the restriking.

What is claimed is:

1. Discharge lamp having a discharge vessel filled with a discharge medium, a strip-shaped cathode (2) and a strip-shaped anode (1) as well as a dielectric layer between at least the anode (1) and the discharge medium, the anode (1) being distinguished from the cathode (2), characterized in that the anode (1) runs in a meandering shape such that the spacing between the cathode (2) and the anode (1) is modulated by the meandering shape.

2. Discharge lamp according to claim 1, in which the cathode (2) runs essentially in a straight line.

3. Discharge lamp according to claim 2, in which the meandering shapes of anodes (1), which run on both sides of the cathode (2), run in phase locally relative to one another, such that the points of minimum spacing between the cathode (2) and the respective anodes (1) alternate along the cathode (2).

4. Discharge lamp according to claim 1, in which a plurality of cathodes (2) and a plurality of anodes (1) are arranged alternately in individual strips.

5. Discharge lamp according to claim 1, in which the meandering shape(s) essentially has/have a sinusoidal course.

6. Discharge lamp according to claim 1, in which the meandering shape(s) essentially has/have a sawtooth course.

7. Discharge lamp according to claim 1, in which the meandering shape(s) essentially has/have a rectangular course.

8. Discharge lamp according to claim 1, in which the meandering shape(s) essentially has/have a course lit in the shape of semicircular waves.

9. Discharge lamp according to claim 1, in which its holds for the quantitative ratio of a difference between a maximum striking distance $d_{max}$ separating the electrodes (1, 2) in half a period length (SL) of the meandering shape and a minimum striking distance $d_{min}$ separating the electrodes (1, 2) in the half period length (SL) to this half period length (SL) that: $(d_{max}-d_{min})/SL \leqq 0.6$, preferably $(d_{max}-d_{min})/SL \leqq 0.5$, particularly preferably $(d_{max}-d_{min})/SL \leqq 0.4$.

10. Discharge lamp according to claim 1, in which it holds for the ratio of a minimum striking distance $d_{min}$ to a maximum striking distance $d_{max}$ that: $0.3<d_{min}/d_{max}<0.9$, preferably $0.4<d_{min}/d_{max}<0.9$, particularly preferably $0.5<d_{min}/d_{max}<0.9$.

11. Discharge lamp according to claim 1, in which the cathodes (2) have points (6, 7) for local field reinforcement.

12. Discharge lamp according to claim 1, in which electrode regions (5) between the meanders are coated with a more coarsely grained fluorescent material, and the adjacent meanders of the same electrode (1, 2) are coated with a more finely grained fluorescent material.

13. Discharge lamp according to claim 1, in which electrode regions (5) between the meanders are coated with a more coarsely grained fluorescent material, and the adjacent meanders of the same electrode (1, 2) are free from fluorescent material.

14. Discharge lamp according to claim 1, in which electrode regions (5) between the meanders are coated with a thicker dielectric layer and the adjacent meanders of the same electrode (1, 2) are coated with a thinner dielectric layer.

15. Lighting system according to claim 14, in which a ballast has a power control device for controlling the power of the discharge lamp by varying an electric parameter of a pulsed coupling of active power into the discharge lamp.

16. Discharge lamp according to claim 1, in which electrode regions (5) between the meanders are coated with a dielectric layer and the adjacent meanders of the same electrode (1, 2) are free from this dielectric layer.

17. Lighting system having a discharge lamp according to claim 1, and a ballast which is designed for pulsed coupling of active power into the discharge lamp.

18. Lighting system according to claim 17, in which the ballast is designed for a unipolar coupling of active power.

19. Lighting system according to claim 17, in which the ballast is a forward converter for injecting an external voltage pulse from a primary circuit via a transformer into a secondary circuit with the discharge lamp, in order to effect striking and an inner counter-polarization in the discharge lamp, and has a switching device which is designed to interrupt the flow of current after starting on the primary side through the transformer so as to isolate the secondary circuit in order to permit oscillation of the secondary circuit in order to remove the charge effecting the external voltage across the discharge lamp and to lead to restriking by means of the inner counter-polarization in the discharge lamp.

20. Lighting system according to claim 17, in which the ballast is a combined flyback/forward converter and has a switching device in a primary circuit which is designed to interrupt the flow of current on the primary-circuit side through a transformer in order to inject an external voltage pulse into a secondary circuit with the discharge lamp, in order to effect striking and a counter-polarization in the discharge lamp, and then to restart the flow of current on the primary-circuit side through the transformer by means of a reverse voltage pulse to remove the charge, effecting the external voltage across the discharge lamp, from the discharge lamp in order to effect restriking in the discharge lamp with the aid of the inner counter-polarization.

21. Lighting system according to claim 17, in which the ballast comprises a powered primary circuit (P), a secondary circuit (S) containing the discharge lamp (L), and a transformer (T) connecting the primary circuit (P) to the secondary circuit (S), the ballast being designed for the purpose of applying to the discharge lamp (L) external to voltages ($U_L$) with signs alternating from voltage pulse to voltage pulse.

22. Lighting system according to claim 21 , in which the direction of the current ($I_{W1}$) on the primary-circuit side in the transformer (T) alternates from voltage pulse to voltage pulse.

23. Lighting system according to claim 22, in which the transformer has two windings (W1) on the primary-circuit side which are each assigned to one of the two current directions.

24. Lighting system according to claim 23, in which the primary circuit has two switches ($T_Q$) which respectively clock the current through one of the two windings (W1).

25. Lighting system according to claim 17, in which the primary circuit is supplied from an AC source which alternately charges two storage capacitors in half periods, each storage capacitor respectively being assigned to one of the two current directions.

26. Discharge lamp having a discharge vessel filled with a discharge medium, a strip-shaped cathode (2) and a strip-shaped anode (1) as well as a dielectric layer between at least the anode (1) and the discharge medium, characterized in that the cathode (2) and the anode (1) run in a meandering shape, the meandering shapes running in phase oppposition locally relative to one another such that the spacing between the cathode (2) and the anode (1) is modulated by both meandering shapes.

27. Discharge lamp according to claim 26, in which a plurality of cathodes (2) and a plurality of anodes (1) are arranged alternately in individual strips.

* * * * *